United States Patent [19]

Andersen

[11] 4,076,603

[45] Feb. 28, 1978

[54] CAUSTIC AND CHLORINE PRODUCTION PROCESS

[75] Inventor: John N. Andersen, Moraga, CA

[73] Assignee: Kaiser Aluminum & Chemical Corporation, Oakland, Calif.

[21] Appl. No.: 785,722

[22] Filed: Apr. 7, 1977

[51] Int. Cl.[2] ..... C25B 1/16; C25B 1/26

[52] U.S. Cl. ..... 204/98; 204/128

[58] Field of Search ..... 204/98, 128

[56] References Cited

U.S. PATENT DOCUMENTS 3,899,403 8/1975 Coon et al. ..... 204/98

*Primary Examiner*—R. L. Andrews

*Attorney, Agent, or Firm*—Paul E. Calrow; Andrew E. Barlay

[57] ABSTRACT

Alkali metal hydroxide and chlorine are produced in a membrane-equipped electrolysis cell system in a staged manner wherein at least one cell of the system is used to generate a dilute caustic solution and wherein the subsequent cell(s) of the system are used to produce a more concentrated caustic solution by electrolysis of fresh brine and the dilute caustic produced in the first stage which is used in lieu of water in the subsequent stage(s). The stage-wise production of caustic of commercially acceptable concentration results in significant energy savings with corresponding increase in the average life of the membranes employed.

5 Claims, 2 Drawing Figures

Single Stage System for Electrolysis of Brine

Multi-Stage System for the Electrolysis of Brine

CAUSTIC AND CHLORINE PRODUCTION PROCESS

BACKGROUND OF THE INVENTION

Production of alkali metal hydroxides and chlorine by electrolysis of brines is well known in the art. There are many known cell systems employed for this purpose and most of these systems have some common characteristics. Thus, generally, the electrolysis cells employed for the production of caustic and chlorine consist of compartments, designated as anode and cathode compartments. The anode compartment serves for the electrolytic decomposition of aqueous brine, such as an NaCl solution according to equation (1) below:

$$2Na^+ + 2Cl^- \xrightarrow{2E} 2Na^+ + Cl_2 \quad (1)$$

while in the cathode compartment, electrolysis of water takes place in accordance with equation (2) below:

$$2H_2O \xrightarrow{+2E} 2OH^- + H_2 \quad (2)$$

The sodium ions from the anolyte compartment combine with the hydroxyl ions generated in the catholyte compartment resulting in the formation of an aqueous sodium hydroxide solution as shown in equation (3):

$$Na^+ + OH^- \rightarrow NaOH \quad (3)$$

For many years, porous diaphragms were used to separate the anode and cathode compartments. The diaphragms served to separate the cell gaseous products and permitted brine to flow from the anode compartment to the cathode compartment. The brine transport across the diaphragm provided an electrical path for the migration of sodium ions to the cathode compartment. The caustic product formed in the cathode compartment was limited to a concentration of 12% and was contaminated with salt resulting from the brine flow across the diaphragm. The weak caustic product was then concentrated by crystallizing evaporation to a commercial grade containing 50% caustic, contaminated with 1% salt.

In recent years, membrane cells have been developed, in which the porous diaphragm has been replaced with a membrane material. This permits the transport of sodium ions from the anode compartment to the cathode compartment, but prevents transfer of the brine solution. This development has provided a means for production of a high concentration salt-free caustic.

The use of membrane-equipped electrolytic cells has not become widespread in the past because of problems encountered with the stability of the membranes and with the relatively low current and power efficiencies in comparison to the conventional diaphragm cell. Recent efforts have resulted in the development of significantly improved membranes which focused new attention on membrane-equipped electrolytic cells for the production of caustic by brine electrolysis. Thus, it has been recently announced by Asahi Chemical Industry Co., Ltd., in a presentation to The American Chemical Society, during the Centennial meeting at New York, held on Apr. 4–9, 1976, that the world's first membrane-equipped commercial chlor-alkali plant with an annual production capacity of 40,000 metric tons has been put in operation in 1975. The membrane employed in the Asahi Chemical system, as reported at the aboverefe-renced presentation, is a perfluoro carboxylic acid membrane which in comparison to previously recommended perfluoro sulfonic acid membranes, provides stable operations at high current efficiency.

Key economic factors in the operation of membrane cells are the achievement of a long membrane life, the attainment of a high current efficiency, the realization of a low voltage drop at high current densities and the production of a high concentration caustic at the cell. The degree of achievement of these factors is dependent on the physical characteristics of the specific membrane material and will vary with operating conditions.

Maintenance of a high current density reduces the original plant capital investment and the membrane replacement costs. Similarly, a high product concentration reduces the capital and operating costs of evaporation equipment required to bring the caustic product up to commercial concentration. Low voltage drop and high current efficiency reduce the energy requirements which are a substantial portion of the total manufacturing cost. The high cost of membrane materials and maintenance costs associated with membrane replacement require achievement of a long membrane life.

Considerable membrane development work has been done using, primarily, various formulations of perfluoro sulfonic acid and perfluoro carboxylic acid type resins. Each of these membrane formulations has specific properties which vary with the operating conditions. A particular membrane material may have excellent current efficiency characteristics at a 40% caustic concentration, but may have a short life under these conditions. As a result, the cell operating conditions and commercial membrane materials in use today represent a compromise aimed at attainment of the best achievable product cost.

The economics of a typical membrane cell installation show that energy requirements account for 50% of the total manufacturing cost. Capital investment and membrane replacement amount to 25% and 8%, respectively, of the total manufacturing cost.

From these figures, it can be seen that production of caustic and chlorine by membrane cell electrolysis is a relatively energy and capital intensive process. Modifications to the electrolysis process resulting in energy and capital savings, are therefore of foremost importance.

It has now been found that significant savings can be achieved by using the instant system for the production of caustic, wherein in at least one cell of a membrane-equipped electrolysis system, a caustic solution of relatively low concentration is produced by electrolysis of NaCl containing brine. Caustic of desired high concentration is then produced by electrolyzing brine in a second stage using the dilute caustic produced in the first stage in lieu of water. This staging of the caustic production results in lower energy consumption/ton of caustic produced in comparion to prior art systems with simultaneous increase in the average life of the membranes employed and reduction in capital investment.

BRIEF SUMMARY OF THE INVENTION

In the production of alkali metal hydroxide and chlorine by electrolysis of an aqueous alkali metal salt solution in the anode compartment of a multi-compartment cell system and the electrolysis of water in the cathode compartment of the system, wherein the compartments of the cells are separated by a membrane-type diaphragm which allows migration of alkali metal ions from the anode to the cathode compartment, the improvement which comprises providing a cell system wherein in at least one cell of the system, a relatively low concentration alkali metal hydroxide solution is produced, wherein in at least one other cell of the system, a relatively high concentration alkali metal hydroxide solution is produced by providing the cathode compartment of this cell, in lieu of water, with the relatively low concentration alkali metal hydroxide solution produced in the other cell. By using the stagewise production of caustic of the desired, relatively high concentration, the average energy consumption per unit weight of alkali metal hydroxide is significantly reduced in comparison to the power consumption of single-stage caustic producing electrolytic systems. In addition, the overall membrane life is increased over the life of membranes utilized in single-stage electrolysis systems. The present system combines energy savings with high current efficiency and desirable operating parameters without sacrificing any of its advantages.

DETAILED DISCUSSION OF THE INVENTION

The present invention relates to the production of alkali metal hydroxide solutions and chlorine by the electrolysis of an alkali metal chloride solution. More particularly, it concerns an improved electrolysis system, wherein alkali metal hydroxide of relatively low concentration is made in at least one cell of the system and wherein this dilute solution is introduced in lieu of water in the cathode compartment of at least one other cell of the system, the anode compartment of which is charged with alkali metal salt solution to be electrolytically decomposed for the production of an alkali metal hydroxide solution of relatively high concentration.

For the purposes of the present invention, the terms "alkali metal hydroxide" and "caustic" refer to sodium hydroxide (NaOH); the term "alkali metal chloride" means sodium chloride (NaCl); the expression "brine" refers to a sodium chloride-containing aqueous solution whether found in nature or made by dissolving NaCl in water.

The terms "relatively low concentration" and "dilute" in context of the present invention refer to aqueous solutions containing dissolved NaOH in the range of about 10–25% by weight. The terms "relatively high concentration" or "commercial grade" caustic solutions for purposes of the invention refer to aqueous solutions of about 25–50% by weight NaOH content.

Figure 1:
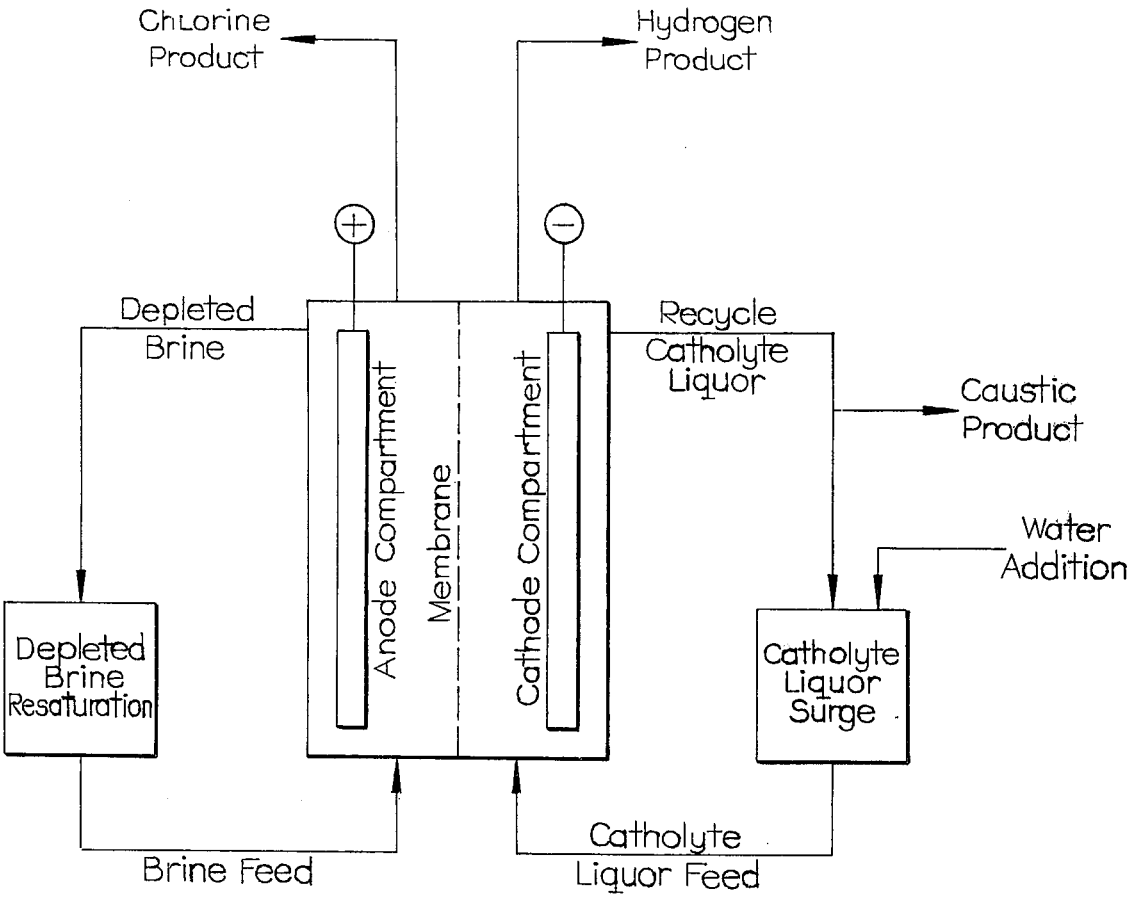
Fig-1 PRIOR ART
FIG. 1 shows a cross-sectional view of a prior art membrane-equipped cell used for the production of caustic and chlorine.

The instant invention employs conventional electrolytic cells for the production of caustic and chlorine. Conventional electrolytic cells, generally referred to as multi-compartment cells, consist of anode and cathode compartments separated by a diaphragm. The anode compartment, as shown in FIG. 1, is equipped with an anode, for purposes of this invention, the anode employed can be of any known design, for example, a dimensionally stable metal anode. The cathode compartment is equipped with a metal cathode, again to accomplish the purposes of the present invention, the cathode employed can be of any known design and material of construction. It is also possible to use a number of these cells in a bipolar configuration.

The diaphragm is generally impervious to fluid flow; however, it allows passage of sodium ions from the anode compartment to the cathode compartment. In recent cell constructions, the diaphragm consists of a membrane combined with an ion exchange resin of insoluble nature, the resin has a negative charge which allows passage of positive ions through the openings of the membrane while repelling ions of negative charge. The openings of the membranes are such that passage of brine, i.e., NaCl molecules, through the membrane is minimized and back-migration of NaOH from the cathode compartment is substantially reduced. Currently, membranes containing perfluoro sulfonic acid or perfluoro carboxylic acid polymers are used. These membranes exhibit a high resistance to caustic and other chemicals present in the cell, possess dimensional stability and have relatively low electrical resistance to prevent a significant voltage drop across the compartments. For the instant process, the membrane utilized may be of any material, provided its characteristics satisfy the foregoing requirements.

Operations of the cell in a simplified version consists of electrolysis of a brine solution in the anode compartment. Electrochemical decomposition of the brine in the anode compartment results in the generation of sodium ions ($Na^+$) and chlorine gas ($Cl_2$). Gaseous chlorine, as well as depleted brine, are removed from the anode compartment and fresh brine is introduced in a volume sufficient to provide an essentially constant NaCl concentration in the anode compartment. Sodium ions generated by the electrolysis pass through the membrane and reach the cathode compartment where electrolysis of water takes place to form hydroxyl ions ($OH^-$) and hydrogen gas ($H_2$). The sodium ions combine with the hydroxyl ions to form an aqueous sodium hydroxide solution which is removed from the cathode compartment at a predetermined rate. A uniform caustic concentration is maintained in the cathode compartment by the circulation of the caustic and controlled water addition.

The alkali metal chloride solution utilized for the production of caustic and chlorine can be obtained from any suitable source, for example, by using naturally occurring NaCl brines or by dissolution of NaCl. In any event, to assure optimum operation conditions, and high operating efficiency, the salt solution employed should be of high purity.

The rate at which the brine solution is charged to the anode compartment and the rate at which the depleted solution is removed is usually controlled in a manner as to obtain an approximately 10–50% salt utilization. In other words, about 10–50% of the NaCl content of the brine is electrolyzed prior to removal of the depleted solution.

In the prior art, the concentration of the caustic liquor in the catholyte compartment is maintained constant by use of a circulation loop as shown in FIG. 1. The concentration is maintained by constantly withdrawing a product stream containing a quantity of caustic essentially equivalent to the production of the cell, and by constantly adding water to satisfy the water requirements of the cell. In this mode of operation, the concentration of caustic liquor in the cathode compartment is essentially the same as the concentration of the caustic product. This mode of operation imposes severe limitations on the design and operation of the membrane cell in that the membrane material must be tailored for optimum operation at the product caustic concentration. This has led to economic design compromises affecting the caustic product concentration, membrane life, cell power consumption and feed brine composition, etc.

In the present invention, significant improvements can be achieved by use of a multistage operating mode, particularly as far as power consumption and membrane life are concerned. In the novel multistage system, production of caustic and chlorine is divided into two or more stages. In the first stage of the multistage operation, a relatively low concentration of caustic solution is produced in one or more electrolytic cells operating in series or parallel.

The operation of the first stage cells is similar to the operation described in FIG. 1, except that the caustic effluent concentration is lower than the usual plant caustic product concentration. The caustic effluent from the first stage cells is used as make-up for the catholyte circulation loop of the subsequent stage(s). The multistage concept of the instant process is shown schematically in FIG. 2 which depicts the essential components of a two-stage system.

The membrane characteristics, ampere density, brine composition and other design variables can be optimized for each stage of the electrolysis. Although membranes can be formulated for specific applications, it is generally understood that as the catholyte concentration is increased, the life of the membrane and the cell current efficiency are reduced and the cell voltage drop is increased.

In the following Examples, the effect of the instant process on energy savings and membrane life extension is illustrated. For ready understanding of the principles involved in the process, the current densities in both stages of the multistage system were kept at the same level with no migration of water occurring from the anode compartment to the cathode compartment through the membrane. Also, to facilitate understanding of the principles involved in the instant process, a linear relationship was assumed between the caustic concentration in the catholyte compartment and cell voltage, current efficiency and membrane life. In other words, at high caustic concentrations, the cell voltage increases, the cell efficiency drops and the life of the membrane decreases. Conversely, at lower caustic concentrations, the cell voltage decreases, the cell efficiency increases and the life of the membrane is extended.

EXAMPLE I

A. In a prior art, single-stage, membrane-equipped electrolyzer, such as shown in FIG. 1, a caustic solution of 30% by weight NaOH content is made by electrolysis of a sodium chloride brine. The cell voltage is maintained at 4.25 volts and the cell current efficiency is 93%. Since theoretically, 607.8 kAh is required for the production of 1 ton NaOH, the energy consumption of the cell is calculated as follows:

$$\text{Energy Consumption/ton of NaOH} = \frac{607.8\ \text{kAh} \times \text{Cell Voltage}}{\text{Cell Current Efficiency}} = \frac{607.8 \times 4.25}{0.93} = 2778\ \text{kWh}$$

Under these operating conditions in a single-stage prior art cell, the membrane life is about 12 months.

Figure 2:
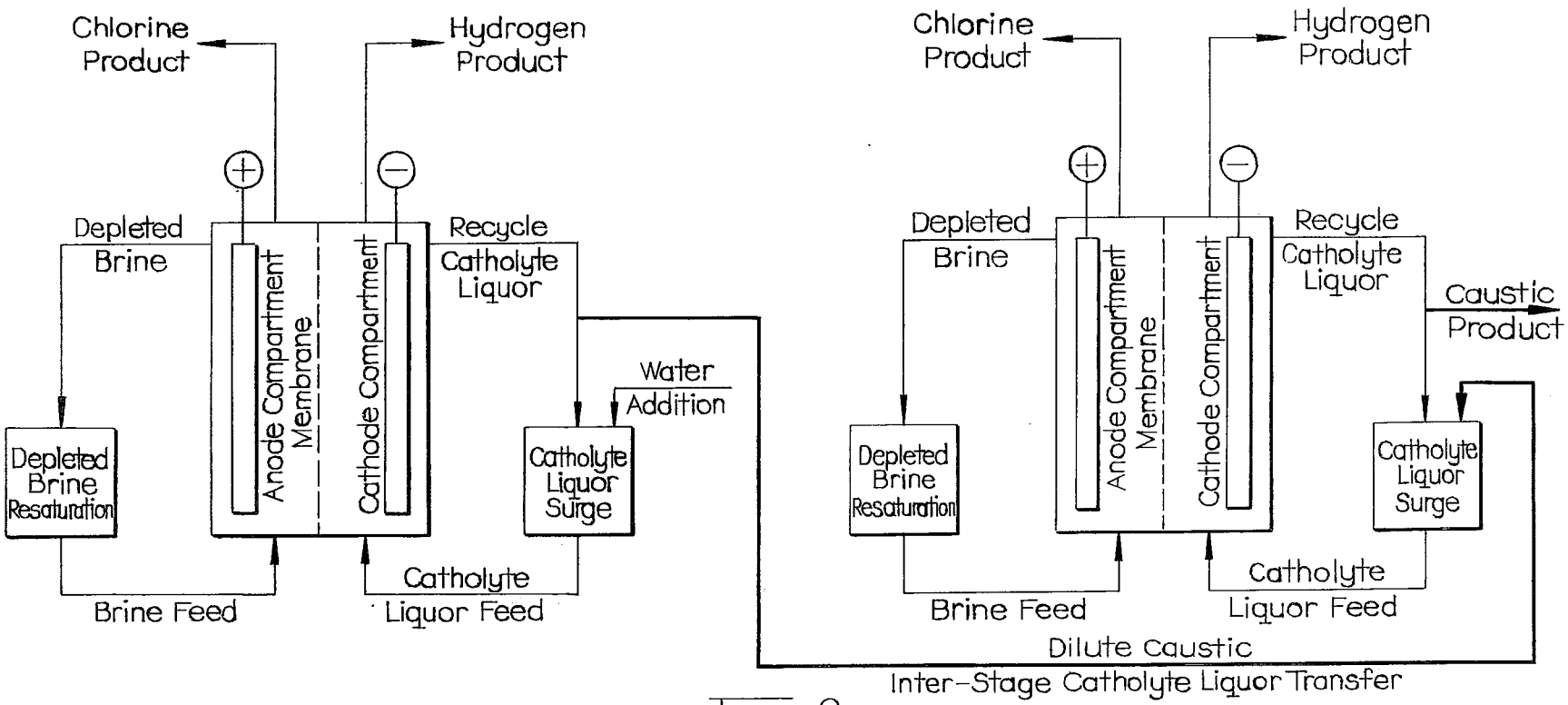
FIG. 2 presents a schematic view of the instant invention employing a multistage membrane-equipped cell system for the production of caustic and chlorine.

B. To show the significant reduction in energy consumption and extension in membrane life obtainable by the use of the instant invention, a multistage system, such as shown in FIG. 2 and employing one first-stage and one second-stage electrolysis cell, was employed. In the first stage, 50% of the caustic (NaOH) solution was produced at a concentration of about 16.3%, while from the second stage, caustic solution of 30% by weight NaOH was recovered.

In the first stage, the cell voltage was maintained at 3.57 volts and a current efficiency of 95.7% was obtained. Consequently, the energy consumption in the first stage is calculated as follows:

$$\text{Energy consumption/ton of first-stage NaOH} = \frac{607.8\ \text{kAh} \times \text{Cell Voltage}}{\text{Cell Current Efficiency}} = \frac{607.8 \times 3.57}{0.957} = 2267\ \text{kWh}$$

In the second stage, where in lieu of water the NaOH solution produced in the first stage is added to the cathode compartment, the cell voltage employed for the production of caustic of commercial concentration is 4.25 volts at a cell current efficiency of 93%. Consequently, the energy consumption of this cell is calculated as follows:

$$\text{Energy consumption/ton of second-stage NaOH} = \frac{607.8 \times \text{Cell Voltage}}{\text{Cell Current Efficiency}} = \frac{607.8 \times 4.25}{0.93} = \underline{\underline{2778\ \text{kWh}}}$$

Combined energy consumption = 2267 + 2278 = 5045 kWh, but since in each cell of the multistage system only 50% of the total NaOH is produced, the average energy consumption in the multistage system is $$\frac{5045}{2} = \underline{\underline{2522}}\ \text{kWh/ton of NaOH end product.}$$

In comparing this energy consumption with the consumption in a single-cell system for the same quantity of NaOH of the same concentration, it can be seen that the energy savings provided by the instant invention is 2778 kWh − 2522 kWh = 256 kWh, amounting to a savings of approximately 9.2%.

In addition to this significant energy savings, the average membrane life is also considerably extended. Thus, in the first stage of the instant system, the membrane has a life of approximately 18 months under the process conditions shown above; in the second stage of the system, where the high concentration of caustic is made, the membrane life is about 12 months. The average of the membrane lives in the first and second stages is $$\frac{18 + 12}{2} = 15\ \text{months,}$$

which, in comparison to the life shown (12 months) in "A" above for the single-stage system, is a 25% increase.

EXAMPLE II

To indicate the flexibility of the instant process and some of the changes in process conditions which the operator of the multistage system can readily vary, in this example, a 30% by weight NaOH solution is produced in two stages, wherein in the first stage, 75% of the total NaOH production is accomplished, while in the second stage, the remaining balance (25% by weight) of NaOH is produced. This production ratio is accomplished by employing three first-stage cells and one second-stage cell where the final NaOH concentration of 30% by weight is achieved. Thus, in the first-stage cells, a caustic solution of about 23.4% by weight NaOH concentration is made at an average cell voltage of 3.92 volts and at an average current efficiency of 94.3%. The second-stage cell of the multistage system, where the 23.4% caustic solution is concentrated to 30% by weight NaOH, operates at 4.25 volts at a current efficiency of 93%.

The energy consumption in the first-stage cells is calculated as follows:

$$\text{Energy consumption/ton of first-stage NaOH} = \frac{607.8 \text{ kWh} \times 3.92}{0.943} = 2527 \text{ kWh},$$

but since 75% of the NaOH is produced in these cells, the energy consumption is only 75% of this value, e.g., 1895 kWh.

In the second stage, the cell voltage is 4.25 volts at a current efficiency of 93%, the energy consumption is:

$$\text{Energy consumption/ton of second-stage NaOH} = \frac{607.8 \times 4.25}{0.93} = 2778 \text{ kWh},$$

since only 25% of the total NaOH is produced in this cell, the energy consumption is only $$\frac{2778}{4} = 695 \text{ kWh}.$$

The total energy consumption of the system is the sum of 1895 kWh (first-stage cells) + 695 kWh (second-stage cell) = = 2590 kWh/ton of NaOH end product.

In comparison to a single-stage system, where the energy consumption is 2778 kWh/ton of NaOH produced, the instant process results in an energy savings of 188 kWh, which is a 6.8% savings. As far as membrane life is concerned, the life of the membranes in the first-stage cells is about 15 months, while in the second stage, all it is is about 12 months. Since 75% of the NaOH production is made in the first stage and only 25% in the second stage, the average membrane life is $(15 \times 0.75) + (12 \times 0.25) = = 14.25$ months, which is about a 19% increase in membrane life experienced over the life of a membrane used in a single-cell system. It is to be understood that the multistage caustic production system of the instant process may employ two or more stages for the production of commercial grade caustic. Thus, for example, the system may include at least three stages wherein the caustic concentration is increased gradually from the first stage to the last stage.

It is to be understood that the multistage caustic production system of the present invention lends itself to a multiplicity of variations concerning the number of first- and second-stage cells, the operating conditions utilized in these cells and also the concentrations of caustic produced in the first and/or subsequent stages. Consequently, the above examples are considered as illustrative only without intending to limit the scope of the instant process to the specific conditions described. The extent and scope of the instant invention are only limited by the scope of the appended claims.

What is claimed is:

1. In the process of producing sodium hydroxide and chlorine by the stage-wise electrolysis of sodium chloride-containing brine, wherein in the first stage an electrolytic cell, consisting of anode and cathode compartments separated by at least one interposed buffer zone, is provided and wherein membranes separate the anode and cathode compartments from the buffer zone and brine is charged to the anode compartment and water is charged to both the buffer zone and to the cathode compartment and as a result of the electrolysis a concentrated sodium hydroxide solution of more than 250 g/l NaOH content is recovered from the cathode compartment and a dilute sodium hydroxide solution of 50–200 g/l NaOH content is recovered from the buffer zone; and the dilute sodium hydroxide solution is then charged to the cathode compartment of at least one second stage electrolysis cell consisting of membrane-separated anode and cathode compartments wherein charging of brine to the anode compartment and electrolysis of the same produces a concentrated sodium hydroxide solution of at least 250 g/l NaOH content in the cathode compartment of this second-stage cell; the improvement which comprises providing at least one first-stage electrolytic cell consisting of membrane-separated anode and cathode compartments without an intermediate buffer zone and wherein brine is charged to the anode compartment and electrolysis of the brine is conducted in a manner so as to produce in the cathode compartment a dilute sodium hydroxide solution containing about 10–25% by weight sodium hydroxide; charging the dilute sodium hydroxide solution to the cathode compartment of at least one second-stage electrolytic cell in lieu of water, introducing brine in the anode compartment of the second-stage cell, electrolyzing the brine and recovering from the cathode compartment of the second-stage cell a sodium hydroxide solution containing 25–50% by weight sodium hydroxide.

2. Process according to claim 1, wherein the membranes used in the cells of the multistage system are made of perfluoro sulfonic or perfluoro carboxylic acid polymers.

3. Process according to claim 2, wherein the membranes separating the anode and cathode compartments of the electrolysis cells are made from a combination of a perfluoro sulfonic or carboxylic acid polymer combined with an ion exchange resin of insoluble nature.

4. Process according to claim 1, wherein both the first and second stages of the multistage electrolysis system consist of two or more cells.

5. Process according to claim 1, wherein the electrolytic production of caustic solution having a sodium hydroxide concentration in the range of about 25 to about 50% by weight is accomplished in a multistage system having two or more stages.

* * * * *